US007073451B1

(12) United States Patent
Okamoto et al.

(10) Patent No.: US 7,073,451 B1
(45) Date of Patent: Jul. 11, 2006

(54) FURNACE WALL STRUCTURE

(75) Inventors: Toshihiko Okamoto, Kure (JP); Junichiro Matsuda, Kure (JP); Atsushi Furukawa, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/523,033

(22) PCT Filed: Sep. 8, 2003

(86) PCT No.: PCT/JP03/11425

§ 371 (c)(1),
(2), (4) Date: Feb. 2, 2005

(87) PCT Pub. No.: WO2004/023037

PCT Pub. Date: Mar. 18, 2004

(30) Foreign Application Priority Data

Sep. 9, 2002 (JP) ..... 2002-263449

(51) Int. Cl.
*F23M 5/00* (2006.01)
*F22B 37/24* (2006.01)
*F22G 3/00* (2006.01)
*F22G 7/00* (2006.01)

(52) U.S. Cl. ..... 110/336; 122/467; 122/510

(58) Field of Classification Search ..... 165/179; 122/460, 467, 510, 406.4, 479.1; 110/336, 110/337

See application file for complete search history.

(56) References Cited

U.S. PATENT DOCUMENTS 2,719,210 A * 9/1955 Chapman ..... 219/137 R
3,434,460 A * 3/1969 Schroedter ..... 122/406.4
3,927,646 A * 12/1975 Dungey et al. ..... 122/6 A (Continued)

FOREIGN PATENT DOCUMENTS

JP 61-23004 2/1986

(Continued)

OTHER PUBLICATIONS

English Language Abstract of JP 2001-525050.

(Continued)

*Primary Examiner*—Kenneth Rinehart
(74) *Attorney, Agent, or Firm*—Greenblum & Bernstein, P.L.C.

(57) ABSTRACT

A furnace wall comprises: a furnace wall bottom part composed of furnace wall tubes having upward-spiraled fluid passages; a nose part which has nose wall tubes disposed in a middle part of a furnace rear wall adjoining the furnace wall bottom part; and a screen part having screen tubes, wherein the terminal parts of the furnace wall tubes are located lower than the nose part. Consequently, the drain generated in the nose wall tubes while the operation of the boiler is suspended can naturally fall inside the furnace wall tubes located lower than the nose part, and in a case where the header is connected with the terminal parts of the furnace wall tubes, the drain generated in the nose wall tubes can naturally fall inside the header. In addition, the furnace wall tubes which extend upright from the terminal parts of the furnace wall tubes can be provided to connect parts of the furnace wall tubes directly with the header, to connect the header with the nose wall tubes via vertical tubes and; and to connect other parts of the furnace wall tubes directly with the screen tubes, thereby integrating the vertical furnace wall tubes, the vertical tubes, and the screen tubes by being welded via membrane bars. This results in the furnace wall structure not requiring reinforcing supports for supporting the weight of the furnace wall bottom part.

3 Claims, 8 Drawing Sheets

U.S. PATENT DOCUMENTS

| | | | | |
|---|---|---|---|---|
| 4,075,979 | A * | 2/1978 | Michel | 122/235.12 |
| 4,864,973 | A | 9/1989 | Lieb et al. | |
| 5,950,574 | A * | 9/1999 | Matsuda et al. | 122/460 |
| 6,651,596 | B1 * | 11/2003 | Wittchow | 122/467 |

FOREIGN PATENT DOCUMENTS

| | | |
|---|---|---|
| JP | 2000-130701 | 5/2000 |
| JP | 2000-186801 | 7/2000 |
| JP | 2001-525050 | 12/2001 |
| WO | 98/51964 | 11/1998 |

OTHER PUBLICATIONS

English Language Abstract of JP 2000-186801.
English Language Abstract of JP 61-23004.
English Language Abstract of JP 2000-130701.

* cited by examiner

FURNACE WALL STRUCTURE

TECHNICAL FIELD

The present invention relates to a furnace structure composed of a combustion chamber which is the steam generator of a boiler for thermal power generation, and more specifically, to the furnace wall structure of the furnace rear wall.

BACKGROUND ART

FIG. 6 shows a simplified side view of the wall tubes forming the wall face of the furnace which composes the combustion chamber of a conventional boiler for thermal power generation.

The combustion chamber of the boiler for thermal power generation is composed of a furnace wall 1 formed by arraying furnace wall tubes 2*a* for conveying water, steam, or a fluid mixture of them at regular intervals, and welding these furnace wall tubes 2*a* via membrane bars 3 disposed therebetween (See FIG. 2).

The furnace wall 1 is provided with a furnace wall bottom part A composed of the furnace wall tubes 2*a* having upward-spiraled fluid passages; a nose part C which has nose wall tubes 5*a* disposed in a middle part of a furnace rear wall B adjoining the furnace wall bottom part A with a side view resembling a sidewise V (<); and a screen part D having screen tubes 7.

There are also plural burners 4 provided for supplying fuel from outside for combustion, which are arrayed in each of the plural stages provided in the vertical direction at corresponding positions on the lower side of the front wall and rear wall of the gas flow of the furnace wall 1. These burners 4 heat the fluid inside the furnace wall tubes 2*a* and make it move upwards from the furnace wall bottom part A inside the inclined furnace wall tubes 2*a*.

The fluid heated by the burners 4 receives a different amount of heat depending on the arrayed position of the furnace wall tube 2*a* provided for conveying the fluid, and on the positional relationship between the furnace wall tube 2*a* and the burners 4. Therefore, in order to make the amount of heat received by the fluid uniform, regardless of the arrayed position of the furnace wall tube 2*a* and the positional relationship between the furnace wall tube 2*a* and the burners 4, the furnace wall tubes 2*a* in the furnace wall bottom part A are upward-spiraled. Such a structure of the upward-spiraled furnace wall tubes 2*a* of the conventional boilers for thermal power generation is disclosed in Japanese Published Unexamined Patent Application No. 2000-130701, paragraph [0027].

FIG. 7 and FIG. 8 (as viewed from the direction of the lines II—II of FIG. 7) show a detailed structure of the connection part (hereinafter also referred to as the transition part) between the spiral furnace wall tubes 2*a* in the furnace rear wall, and the nose wall tubes 5*a* and the screen tubes 7.

The combustion gas G in the furnace, as shown in FIG. 6, rises from the furnace wall bottom part A; turns at the nose part C to the left side on the drawing; passes through the furnace ceiling part; and then flows towards an unillustrated furnace rear heat transfer part. Thus, the combustion gas Grises while making a detour in the upper part of the furnace wall 1. In contrast, if the nose part C is absent, the combustion gas G generated at the burners 4 region at the furnace wall bottom part A flows towards the right side on FIG. 6; passes through the furnace ceiling part; and flows towards the unillustrated furnace rear heat transfer part. Without the nose part C, the combustion gas G flows the shortest route in the furnace wall 1 in this manner, which shortens the retention time of the combustion gas G in the furnace, thereby making the combustion of the fuel insufficient. The shortened retention time of the combustion gas G in the furnace also makes the heat storing insufficient in the furnace wall tubes 2*a* and the other heat transfer tube regions in the furnace, thereby causing high-temperature combustion gas G to flow to the furnace rear heat transfer part side. The high-temperature combustion gas G causes the heat transfer tubes arranged on the furnace rear heat transfer part to have clinkers or slag, which are difficult to remove after being hardened.

This makes it necessary to provide the nose part C which must have a complicated tubing structure. The terminal parts of the spiral furnace wall tubes 2*a* are positioned in the intermediate part of the nose part C composed of the nose wall tubes 5*a* and others. Consequently, the header 6 for adjusting the number of tubes and mixing the inner fluid, which is required in the connection part (transition part) between the spirally inclined furnace wall tubes 2*a* and the screen tubes 7 because of the difference in number between the furnace wall tubes 2*a* and the nose wall tubes 5*a*, is conventionally disposed inside the nose part C as shown in FIG. 7.

Other furnace wall tubes 2*b*, which extend upright from the inclined terminal parts of the furnace wall tubes 2*a* whose fluid passages are upward-spiraled, are connected with the header 6. Then the header makes the fluid flow towards the nose wall tubes 5*a*. Between the header 6 and the nose wall tube 5*a* are provided fluid passages 5*f* for conveying the inner fluid downwards. The fluid passages 5*f* are arranged in parallel with the vertical furnace wall tubes 2*b*.

In the transition part, the inclined terminal parts of the furnace wall tubes 2*a* are directly connected with the screen tubes 7, which are composed of thick tubes with higher rigidity than the furnace wall tubes 2*a* so as to support the weight of the furnace wall bottom part A by a small number. However, it is impossible to transfer the weight of the furnace wall bottom part A to the screen tubes 7 only by the furnace wall tubes 2*a* with insufficient rigidity. Therefore, there are reinforcing supports 8 provided between the furnace wall tubes 2*a* and the screen tubes 7 in order to compensate for the rigidity of the furnace wall tubes 2*a* and to transfer the weight of the furnace wall bottom part A to the screen tubes 7.

According to the aforementioned prior art, since the terminal parts of the spirally inclined furnace wall tubes 2*a* are located in the intermediate part of the nose part C, the header 6 is provided to compensate for the difference in number between the furnace wall tubes 2*a* and the nose wall tubes 5*a* and to mix the inner fluid. The header 6 is installed inside the nose part C, and the inner fluid coming out of the header 6 flows through fluid passages 5*f* into the nose wall tubes 5*a* whose side views resembles a sidewise V (<).

Thus in the conventional furnace wall structure, the water inside the fluid passages 5*f* located lower than the header 6 cannot be drained while the operation of the boiler is suspended.

Furthermore, according to the prior art, the reinforcing supports 8 must be installed in the screen tubes 7 that are directly connected with the spirally inclined furnace wall tubes 2*a*, and such a complicated structure leads to a cost increase.

The object of the present invention is to provide a furnace wall structure which can drain the water inside the nose wall tubes while the operation of the boiler is suspended, and also to provide a furnace wall structure which can dispense with the reinforcing supports for supporting the weight of the furnace wall bottom part.

DISCLOSURE OF THE INVENTION

The present invention is a furnace wall structure having a furnace wall 1 installed in a furnace which is the combustion chamber of a boiler for thermal power generation, the furnace wall 1 comprising: a furnace wall bottom part A composed of furnace wall tubes 2*a* having upward-spiraled fluid passages; a nose part C which has nose wall tubes 5*a* disposed in a middle part of a furnace rear wall B adjoining the furnace wall bottom part A; and a screen part D having screen tubes 7, wherein the terminal parts of the furnace wall tubes 2*a* are located lower than the nose part C.

Since the terminal parts of the furnace wall tubes 2*a* are located lower than the nose part C, the drain generated in the nose wall tubes 5*a* while the operation of the boiler is suspended can naturally fall inside the furnace wall tubes 2*a* located lower than the nose part C.

Also, in a case where the header 6 is connected with the terminal parts of the furnace wall tubes 2*a*, the terminal parts of the furnace wall tubes 2*a* are located lower than the nose part C, which makes the drain generated in the nose wall tubes 5*a* naturally fall inside the header 6.

Furthermore, the header 6 can be installed lower than the nose part C and also outside the furnace wall 1. In this case, the header 6 installed outside the furnace wall 1 facilitates draining operations from the header 6 and maintenance operations.

It is also possible that furnace wall tubes 2*b* (2*b*$_1$, 2*b*$_2$) which extend upright from the terminal parts of the furnace wall tubes 2*a* are provided so as to connect parts 2*b*$_1$ of the furnace wall tubes 2*b* directly with the header 6, to connect the header 6 with the nose wall tubes 5*a* via vertical tubes 5*e*$_1$ and 5*e*$_2$; and to connect other parts 2*b*$_2$ of the furnace wall tubes 2*b* directly with the screen tubes 7, thereby integrating the vertical furnace wall tubes 2*b* (2*b*$_1$, 2*b*$_2$), the vertical tubes 5*e*$_1$ and 5*e*$_2$, and the screen tubes 7 by being welded via membrane bars 3.

Thus, in the present invention, the terminal parts of the furnace wall tubes 2*a* having the spirally inclined fluid passages are located lower than the nose part C, which makes it possible to provide the furnace wall tubes 2*b* (2*b*$_1$, 2*b*$_2$) extending upright between the terminal parts of the furnace wall tubes 2*a* and the nose wall tubes 5*a*. This enables the parts 2*b*$_2$ of the furnace wall tubes 2*b* to be directly connected with the screen tubes 7 so as to integrate the vertical furnace wall tubes 2*b* (2*b*$_1$, 2*b*$_2$), the vertical tubes 5*e*$_1$ and 5*e*$_2$, and the screen tubes 7 by being welded via the membrane bars 3, thereby supporting the weight of the furnace wall bottom part A without using reinforcing members.

It is also possible that the parts 2*b*$_1$ of the vertical furnace wall tubes 2*b* are bent downwards to be connected with the header 6; horizontal tubes 5*b*$_1$ and 5*b*$_2$ are provided in such a manner as to be divided from the header 6 into opposite sides in the horizontal direction; the horizontal tubes 5*b*$_1$ and 5*b*$_2$ are connected with the vertical tubes 5*e*$_1$ and 5*e*$_2$ which partly extend upright adjacent to the vertical furnace wall tubes 2*b* (2*b*$_1$, 2*b*$_2$) via the vertical tubes 5*c*$_1$ and 5*c*$_2$ and the horizontal tubes 5*d*$_1$ and 5*d*$_2$; and the vertical tubes 5*e*$_1$ and 5*e*$_2$ are connected with the nose wall tubes 5*a*, respectively.

Thus, the header 6 and the nose wall tubes 5*a* are connected with each other via a connection tube group (5*b*$_1$, 5*b*$_2$ to 5*e*$_1$, 5*e*$_2$) consisting of the horizontal tubes 5*b*$_1$, 5*b*$_2$, 5*d*$_1$, and 5*d*$_2$, the vertical tubes 5*c*$_1$ and 5*c*$_2$, and the vertical tubes 5*e*$_1$ and 5*e*$_2$. The connection tube group (5*b*$_1$, 5*b*$_2$ to 5*e*$_1$, 5*e*$_2$) never causes drain retention, thereby making the drain from the nose wall tubes 5*a* naturally fall into the header 6 quickly.

Although it is not illustrated, the furnace wall 1 is suspended from the ceiling joist supported by a steel column, and the header 6, which is also a heavy material, is also suspended from an adjacent ceiling joist via a spring arm. The furnace wall 1 moves downwards by several to several tens of centimeters by heat extension, and the spring arm can follow the heat extension of the header 6 in the vertical direction, but not the heat extension of the furnace wall 1 in the horizontal direction. However, the connection tube group (5*b*$_1$, 5*b*$_2$ to 5*e*$_1$, 5*e*$_2$), particularly the portions having a side view of an inverted L formed by the vertical tubes 5*c*$_1$ and 5*c*$_2$ and the horizontal tubes 5*d*$_1$ and 5*d*$_2$ can absorb the heat extension of the furnace wall 1 in the horizontal direction.

To provide drain tubes 5*d* at the bottom of the header 6 and to provide an open/close valve 10 at the drain tubes 5*d* facilitate the draining from the header 6.

BEST MODE FOR CARRYING OUT THE INVENTION

An embodiment of the present invention will be described as follows with the drawings. The boiler furnace wall structure of the present embodiment is shown in FIG. 1 to FIG. 5.

Figure 1:
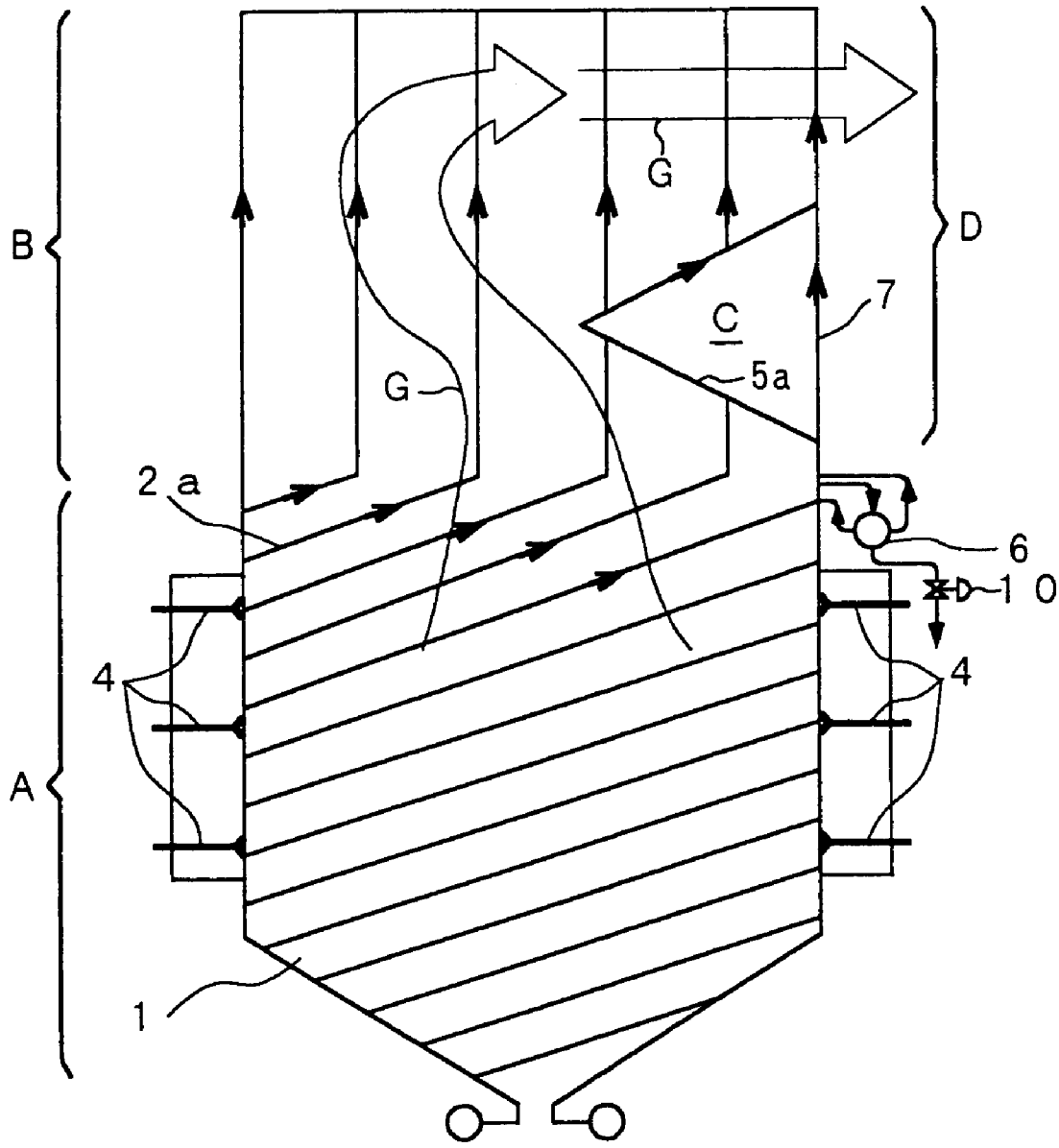
FIG. 1 shows a side view of the furnace wall structure of the embodiment of the present invention.
Figure 2:
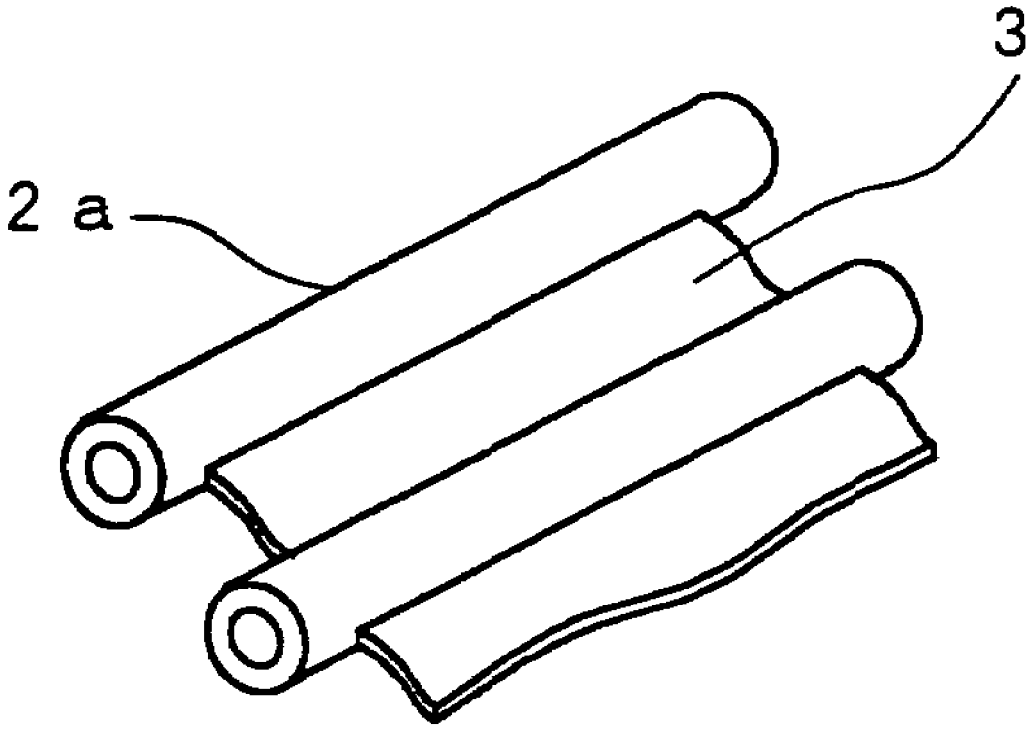
FIG. 2 is a perspective view of a part of the furnace wall structure of FIG. 1.
Figure 3:
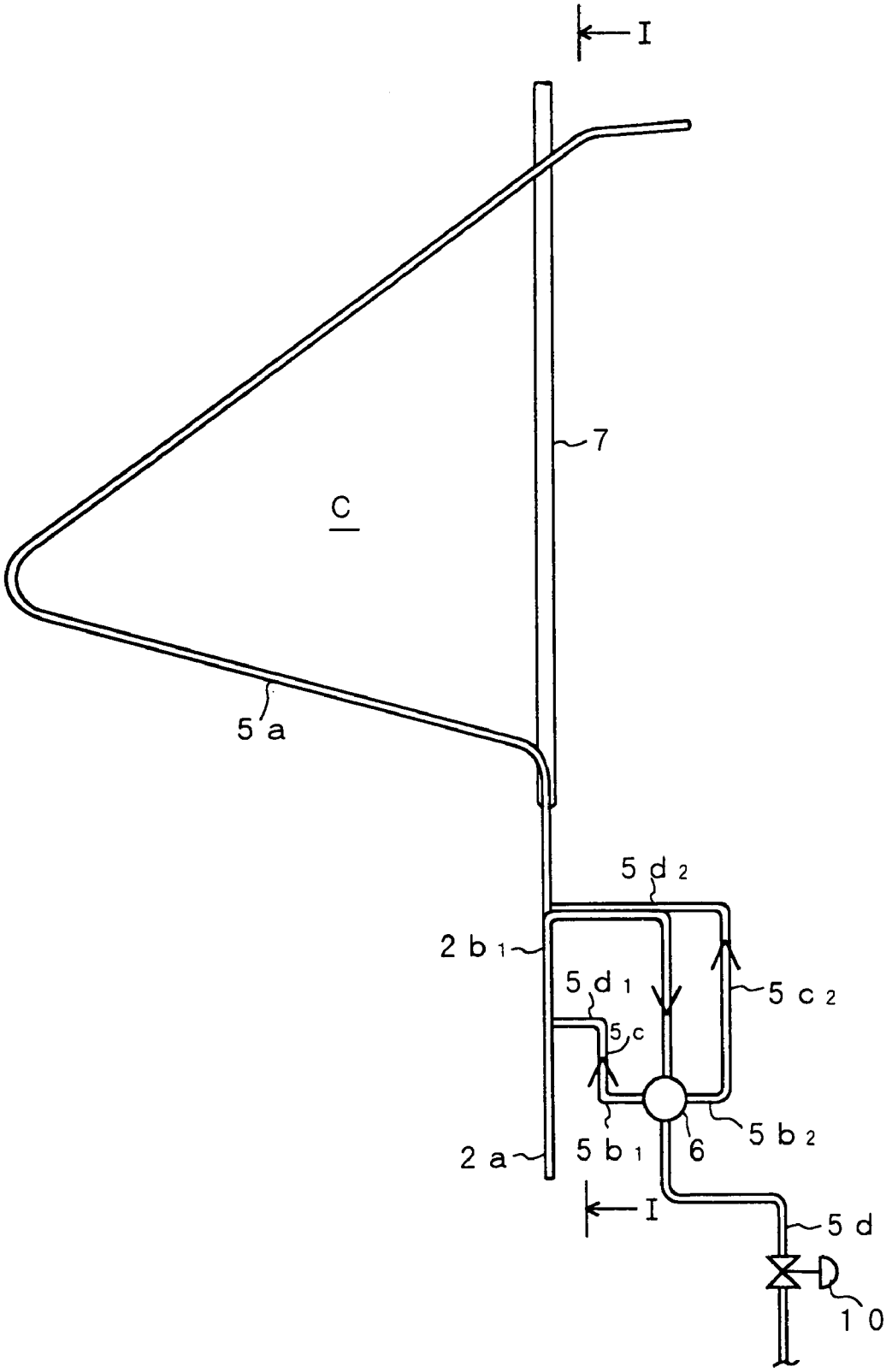
FIG. 3 is a detailed side view of the furnace wall structure of FIG. 1.
Figure 4:
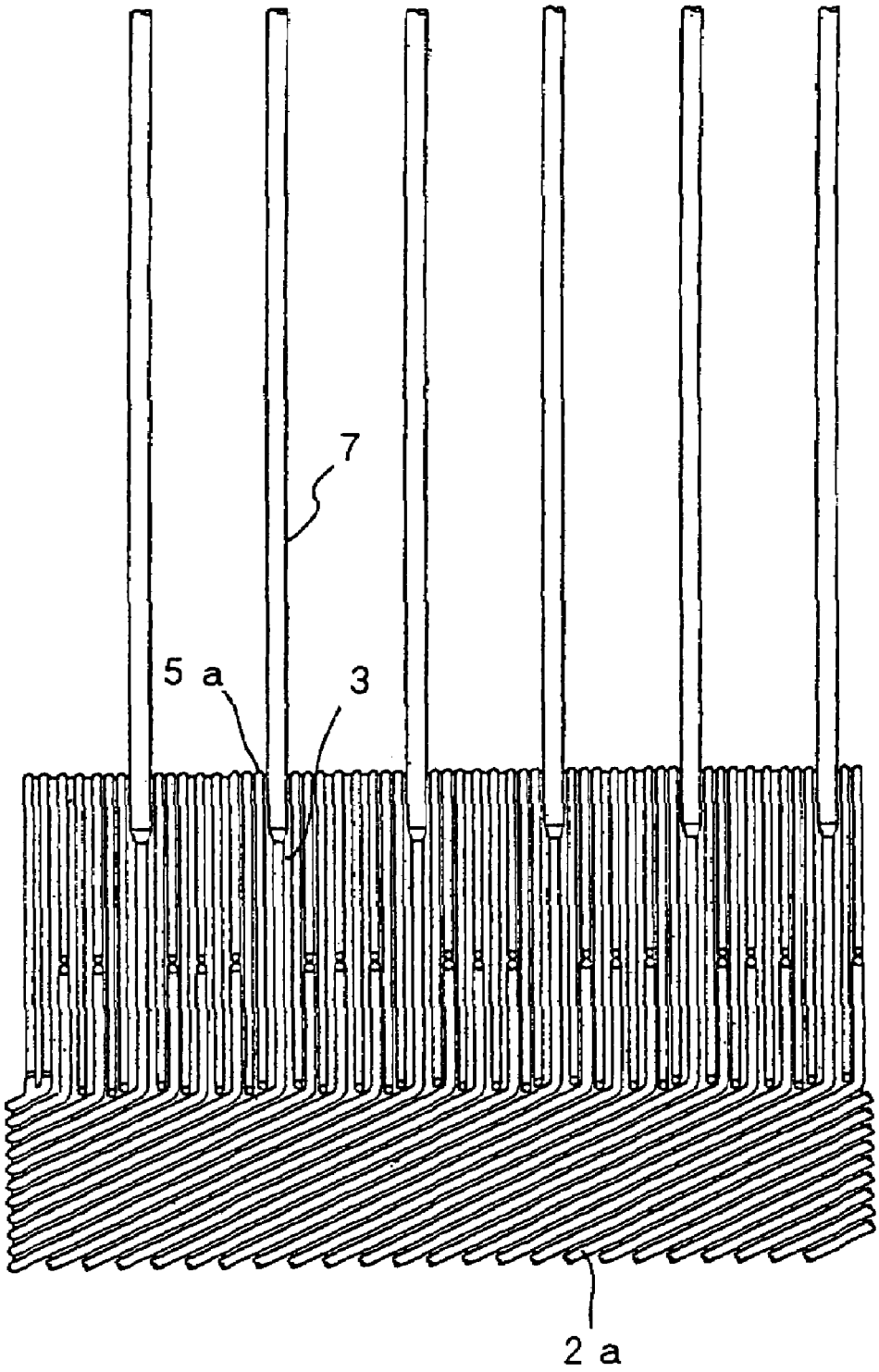
FIG. 4 is a view seen from the direction indicated by the arrows I, I of FIG. 3.
Figure 5:
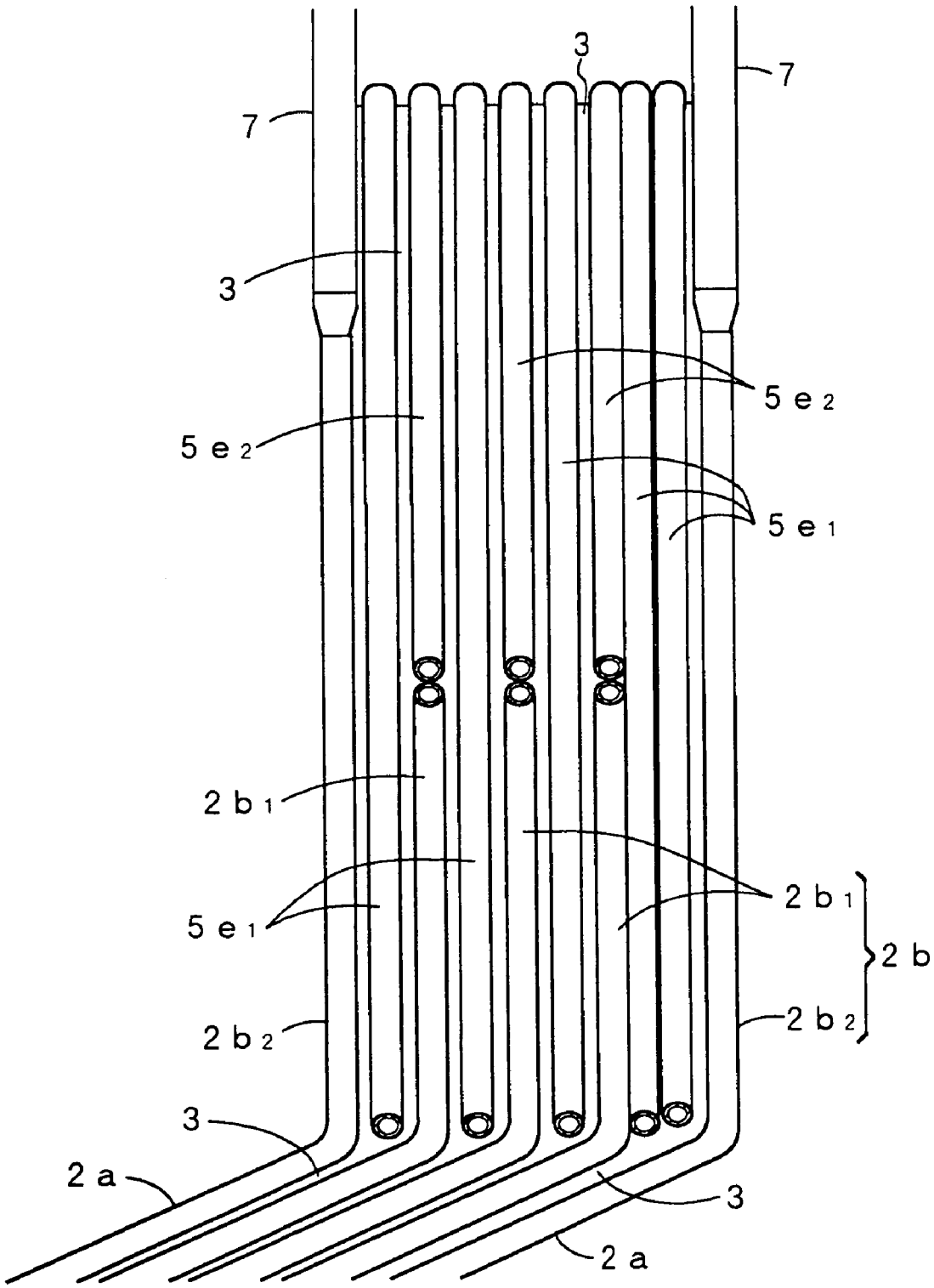
FIG. 5 is an enlarged view of a part of FIG. 4.
Figure 6:
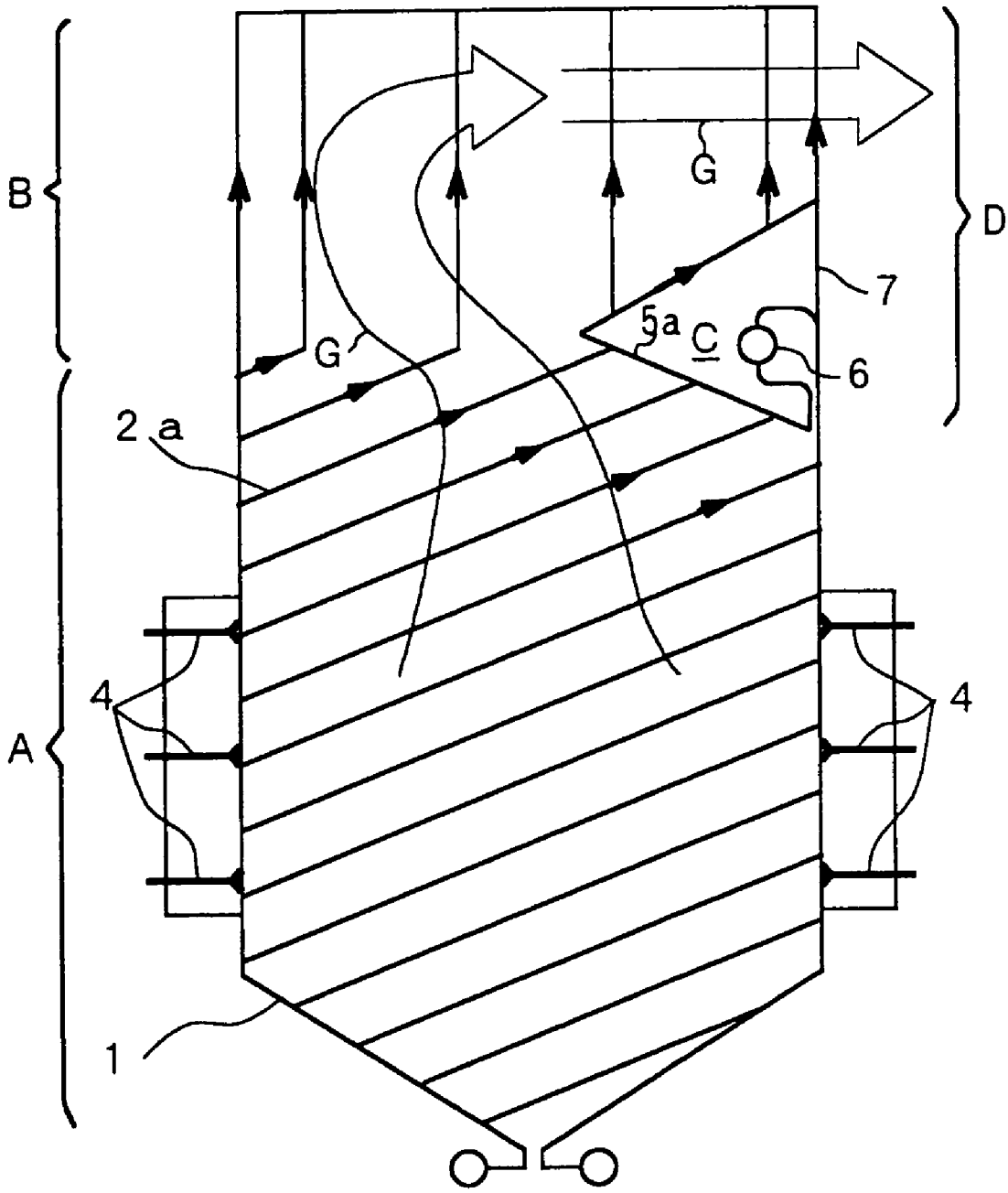
PRIOR ART FIG. 6
FIG. 6 is a side view of the conventional furnace wall structure.
Figure 7:
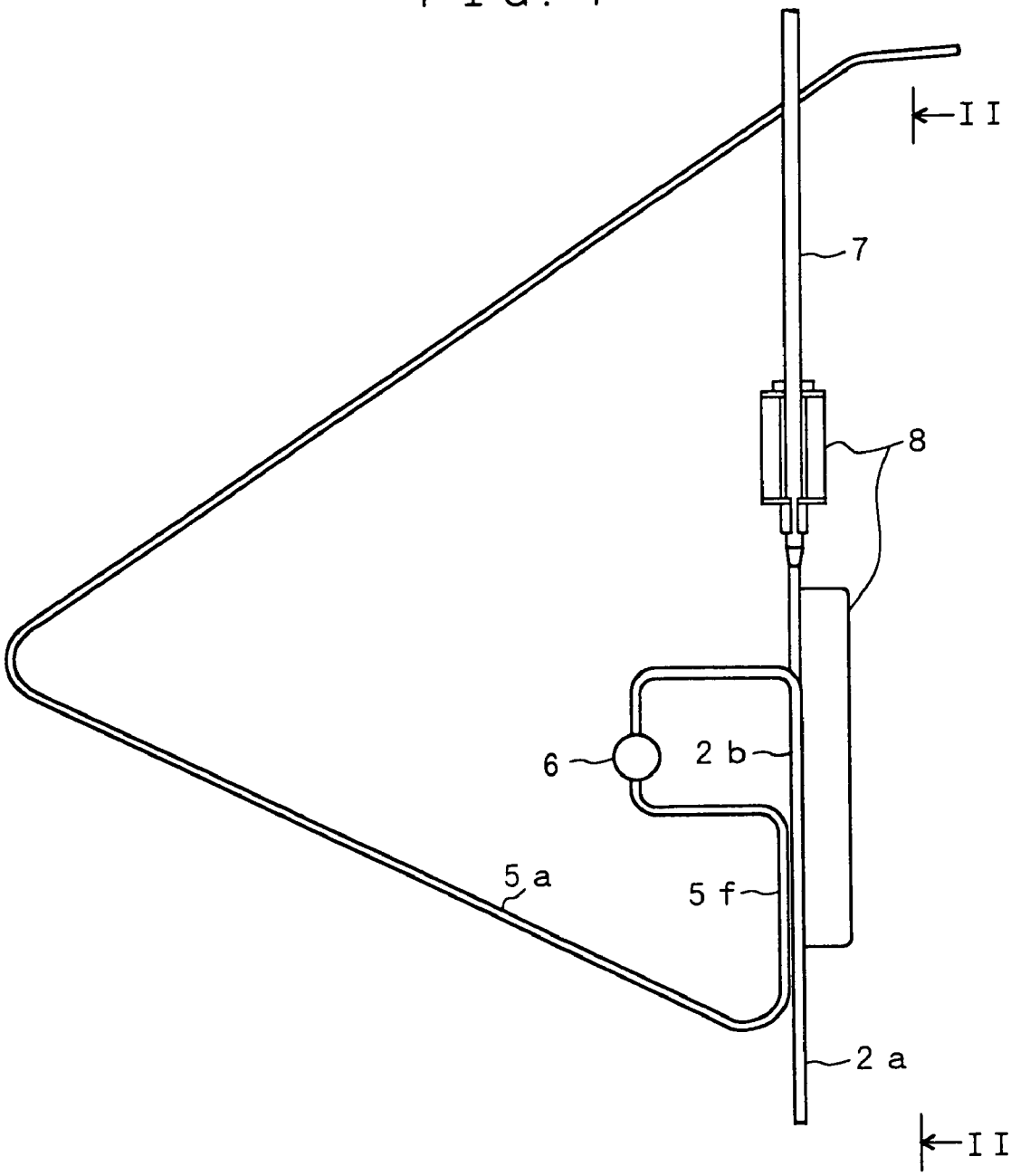
PRIOR ART FIG. 7
FIG. 7 is a detailed side view of the conventional furnace wall structure.
Figure 8:
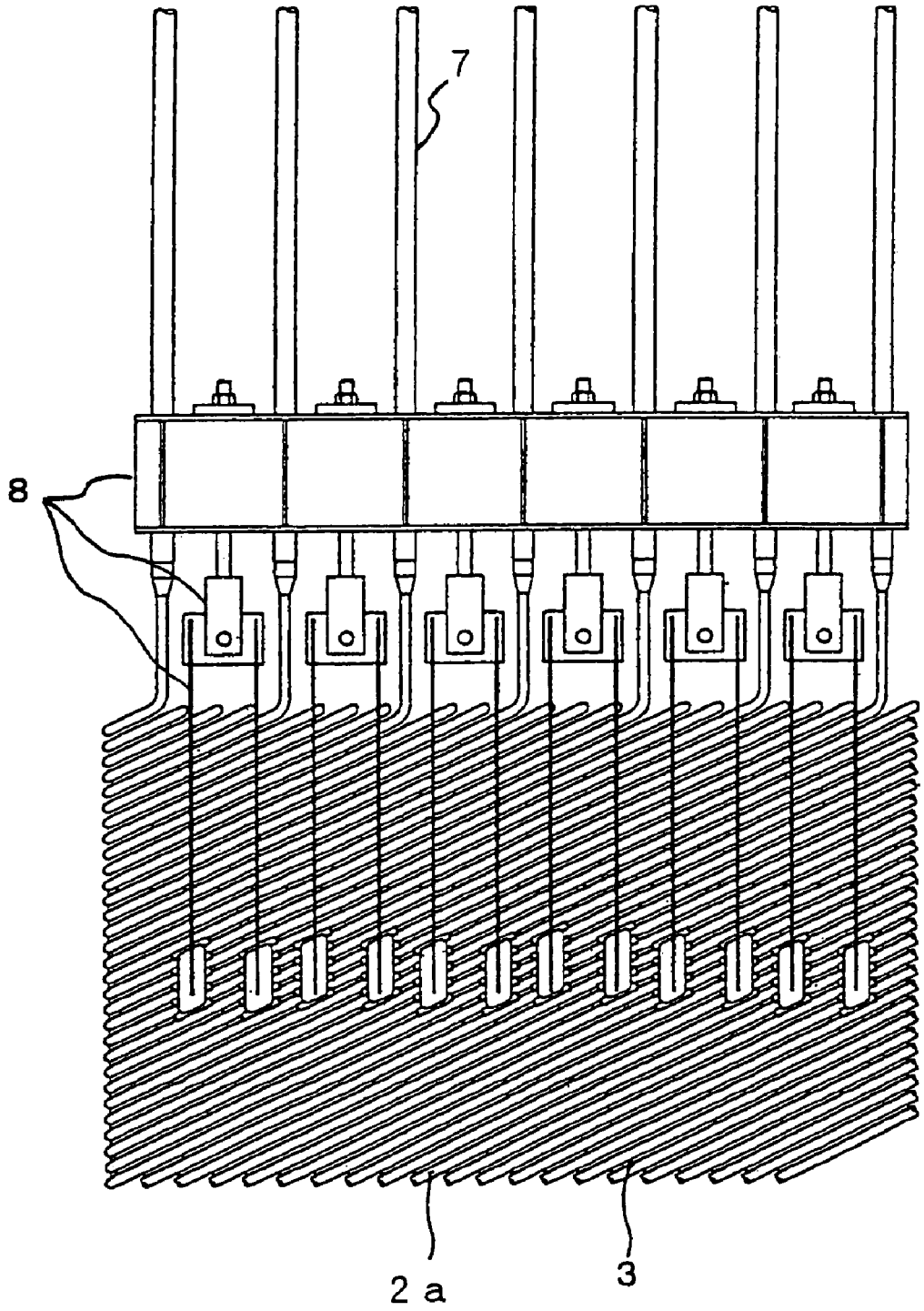
PRIOR ART FIG. 8
FIG. 8 is a perspective view taken along the line II—II of FIG. 7.

Concerning the boiler furnace wall structure of the present embodiment, FIG. 1 shows its simplified side view; FIG. 2 shows a perspective view of a partly cut portion of the furnace wall structure; FIG. 3 shows an enlarged side view of the transition part of the furnace wall tubes from the furnace wall tubes to the nose part; and FIG. 4 shows a view seen from the direction indicated by the arrows I and I of FIG. 3. FIG. 5 is an enlarged view of a part of FIG. 4.

The furnace wall 1 shown in FIG. 1 is provided with a furnace wall bottom part A composed of furnace wall tubes 2*a* having upward-spiraled fluid passages; a nose part C having nose wall tubes 5*a* which is disposed in a middle part of a furnace rear wall B adjoining the furnace wall bottom part A; and an upper screen part D having screen tubes 7.

In the furnace wall 1 of the present embodiment, the terminal parts of the upward-spiraled furnace wall tubes 2*a* are located lower than the nose part C having the nose wall tubes 5*a*. Furthermore, the present embodiment employs a boiler structure where the header 6 for adjusting the number of tubes and mixing the inner fluid that is required because of the difference in number between the furnace wall tubes 2*a* and the nose wall tubes 5*a* is installed lower than the nose part C and also outside the furnace wall 1.

As shown in FIG. 3 to FIG. 5, the terminal parts of the upward-spiraled furnace wall tubes 2*a* are located lower than the nose part C; between the terminal parts of the furnace wall tubes 2*a* and the nose part C are provided vertical furnace wall tubes 2*b* (2*b*$_1$, 2*b*$_2$) extending higher than the terminal parts of the furnace wall tubes 2*a*; and the header 6 for adjusting the number of tubes and mixing the inner fluid that is required because of the difference in number between the furnace wall tubes 2*b* (2*b*$_1$, 2*b*$_2$) and the nose wall tubes 5*a* is installed lower than the nose part C and also outside the furnace wall 1. The parts 2*b*$_1$ of the furnace wall tubes 2*b* are bent downwards to be connected with the header 6. Furthermore, there are horizontal tubes 5*b*$_1$ and 5*b*$_2$ which are divided from the header 6 into opposite sides in the horizontal direction, and which are connected with the vertical tubes 5*c*$_1$ and 5*c*$_2$ partly extending upright adjacent to the inclined furnace wall tubes 2*a*. The vertical tubes 5*c*$_1$ and 5*c*$_2$ are connected, via the horizontal tubes 5*d*$_1$ and 5*d*$_2$, with vertical tubes 5*e*$_1$ and 5*e*$_2$, respectively which partly extend upright adjacent to the furnace wall tubes 2*b* (2*b*$_1$, 2*b*$_2$). The vertical tubes 5*e*$_1$ and 5*e*$_2$ are connected with the nose wall tubes 5*a* whose side views look like a sidewise V (<).

The provision of drain tubes 5*d* at the bottom of the header 6 and the provision of an open/close valve 10 at the drain tubes 5*d* facilitate the draining from the header 6 through the drain tubes 5*d*.

The screen tubes 7 are connected with the parts 2*b*$_2$ of the vertical furnace wall tubes 2*b* adjoining the spiral furnace wall tubes 2*a*, and are composed of comparatively thick tubes so as to support the weight of the furnace wall bottom part A.

In the furnace wall structure of the present embodiment, the terminal parts of the upward-spiraled furnace wall tubes 2*a* are located lower than the nose part C, so that the header 6 that is required in the transition part because of the difference in number between the furnace wall tubes 2*a* and the nose wall tubes 5*a* can be installed lower than the nose part C and also outside the furnace wall 1. This structure has the following effects.

(1) It becomes possible to provide, in the connection part between the header 6 and the nose wall tubes 5*a*, wall tubes (the vertical tubes 5*c*$_1$ and 5*c*$_2$ and the vertical tubes 5*e*$_1$ and 5*e*$_2$) extending upright to make the inner fluid flow upwards, so that the water inside the nose wall tubes 5*a* can naturally fall to the header 6 while the operation of the boiler is suspended.

(2) Locating the terminal parts of the upward-spiraled furnace wall tubes 2*a* lower than the nose part C enables upright extended furnace walls 2*b*$_2$ being provided at the connection part between the spiral furnace wall tubes 2*a* and the screen tubes 7, the furnace wall tubes 2*b*$_1$ are connected with the header 6, and the header 6 is connected with the nose wall tubes 5*a* via the vertical tubes 5*e*$_1$ and 5*e*$_2$ so as to integrate the vertical tubes 5*e*$_1$ and 5*e*$_2$, the screen tubes 7, and the vertical furnace wall tubes 2*b*$_1$ and 2*b*$_2$ by being welded via the membrane bars 3, thereby supporting the weight of the furnace wall bottom part A.

(3) The provision of the drain tubes 5*d* at the bottom of the header 6 and the provision of the open/close valve 10 at the drain tubes 5*d* facilitate the draining from the header 6 by operating the open/close valve 10 installed outside the furnace wall 1, and also facilitates the maintenance operation of the header 6 and the adjacent tube group from outside the furnace wall 1.

INDUSTRIAL APPLICABILITY

According to the present invention, there is no accumulation of water which is the inner fluid inside the nose wall tubes 5*a* while the operation of the boiler is suspended, which facilitates maintenance as compared with the conventional case. Furthermore, the reinforcing supports conventionally installed to support the weight of the furnace wall bottom part A become unnecessary, thereby relatively reducing the cost of equipment.

What is claimed is:

1. A furnace wall structure having a furnace wall installed in a furnace which is the combustion chamber of a boiler for thermal power generation, said furnace wall comprising:

a furnace wall bottom part composed of furnace wall tubes having upward-spiraled fluid passages; a nose part which has nose wall tubes disposed in a middle part of a furnace rear wall adjoining the furnace wall bottom part; and a screen part having screen tubes, wherein the terminal parts of said furnace wall tubes are located lower than the nose part, a header is provided at the connection part between the terminal parts of said furnace wall tubes and said nose wall tubes, and is installed lower than said nose part and outside the furnace wall, furnace wall tubes which extend upright from the terminal parts of said furnace wall tubes are provided so as to connect parts of the furnace wall tubes directly with the header, to connect the header with the nose wall tubes via vertical tubes; and to connect other parts of said furnace wall tubes directly with the screen tubes, thereby integrating the vertical furnace wall tubes, the vertical tubes, and the screen tubes by being welded via membrane bars.

2. The furnace wall structure according to claim 1, wherein the parts of said vertical furnace wall tubes are bent downwards to be connected with the header; horizontal tubes are provided in such a manner as to be divided from the header into opposite sides in the horizontal direction; the horizontal tubes are connected with the vertical tubes which partly extend upright adjacent to the vertical furnace wall tubes via the vertical tubes and the horizontal tubes; and the vertical tubes are connected with the nose wall tubes, respectively.

3. The furnace wall structure according to claim 1, further comprising: drain tubes provided at the bottom of the header; and an open/close valve provided at the drain tubes.

* * * * *